US005370054A

United States Patent [19]

Reams et al.

[11] Patent Number: 5,370,054

[45] Date of Patent: Dec. 6, 1994

[54] SEMICONDUCTOR SLAPPER

[75] Inventors: Robert Reams, Silver Spring, Md.; Judith McCullen, Buffalo Mills, Pa.; Jonathan Terrell, Silver Spring, Md.

[73] Assignee: The United States of America as represented by the Secretary of the Army, Washington, D.C.

[21] Appl. No.: 955,189

[22] Filed: Oct. 1, 1992

[51] Int. Cl.[5] ..... F42C 19/12

[52] U.S. Cl. ..... 102/202.5; 102/202.2; 102/202.7

[58] Field of Search ..... 102/202.2, 202.5, 202.7, 102/202.9, 204, 472

[56] References Cited

U.S. PATENT DOCUMENTS

| | | | |
|---|---|---|---|
| 4,471,697 | 9/1984 | McCormick et al. | 102/202.5 |
| 4,840,122 | 6/1989 | Nerheim | 102/202.5 |
| 4,924,774 | 5/1990 | Lenzen | 102/202.7 |
| 4,944,225 | 7/1990 | Barker | 102/202.5 |
| 5,085,146 | 2/1992 | Baginski | 102/202.5 |
| 5,285,727 | 2/1994 | Reams, Jr. et al. | 102/202.5 |

*Primary Examiner*—Harold J. Tudor

*Attorney, Agent, or Firm*—Freda L. Krosnick; Frank J. Dynda; Jason M. Shapiro

[57] ABSTRACT

An RF-insensitive semiconductor slapper ignitor is created using a silicon substrate having a first metallized portion centrally located on its bottom face to form a Schottky barrier diode thereon, and a second substantially smaller metallized portion centrally located on its top face to form a consumable plug. A flyer disc is disposed atop the second metallized portion and is propelled when the consumable plug vaporizes in response to the high current density associated with ignition. In various embodiments the flyer disc is either an insulating material such as plastic, or polyimide, or formed integral to a top contact metal layer.

2 Claims, 2 Drawing Sheets

SEMICONDUCTOR SLAPPER

GOVERNMENTAL INTEREST

The invention described herein may be manufactured, used and licensed by or for the U.S. Government for governmental purposes without the payment to us of any royalties thereon.

BACKGROUND OF THE INVENTION

The present invention relates to electrical primers and ignitors, and more particularly to an RF-insensitive semiconductor slapper-type ignitor for use in firing in-line low order explosives rapidly and reliably.

Conventional explosives employ mechanical or electrically initiated charge ignitors to create an ignition train which sets off the main propellant. Mechanical propelling charge ignitors are usually provided with percussion caps which are made to fire upon exposure to a mechanical impulse such as that caused by a firing pin or hammer blow. Electrically initiated charge ignitors, on the other hand, fire under the influence of a current pulse which may melt a resistive bridge wire, vaporize a metallic layer at an arc point, or pass through an electrically conductive charge.

Presently, in-line low order explosives are fired by applying a high voltage across a bridge wire which in turn breaks down, thereby propelling a plastic disc (typically around 0.005 inch in diameter and 0.001 inch thick) into the primary charge. U.S. Pat. No. 4,840,122 is an example of such a device.

A problem with bridge wire slapper devices is their sensitivity to electromagnetic (EM) radiation. EM fields may couple with the bridge wire ignitor causing premature initiation. This problem is particularly acute aboard naval vessels which typically support multiple high power electromagnetic sources in close proximity to ordnance.

Various solutions to the problem of EM susceptibility in electrical ignitors, and to RF fields in particular, are discussed in U.S. Pat. No. 5,085,146 to Baginski, and copending U.S. patent application, Ser. No. 866,776, both of which are hereby incorporated by reference. Both devices employ a semiconductor in which two p-n junctions have been created on top and bottom surfaces of a silicon substrate. Conductive layers atop the p-n junctions channel the firing current through the junctions, causing a small plug of conductive material on the top surface to vaporize, thereby igniting an electrically conductive primer charge. These devices, however, function only with high order explosives, relying on contact with a conductive primer mix. They will not fire ammunition currently fitted with slapper-type ignitors, which employ low order explosives and require the slapper ignitor for reasons of safety.

SUMMARY OF THE INVENTION

Accordingly, it is an object of the present invention to provide an RF-insensitive semiconductor slapper ignitor for use with low order explosives.

It is another object of the present invention to provide an RF-insensitive semiconductor slapper ignitor which employs back-to-back Schottky diodes.

It is yet another object of the present invention to provide an RF-insensitive slapper ignitor which does not require a separate flyer disc element.

These objects and others not specifically enumerated are accomplished with a silicon substrate having a first metallized portion centrally located on its bottom face to form a Schottky barrier diode thereon, and a second substantially smaller metallized portion centrally located on its top face to form a consumable plug. A flyer disc is disposed atop the second metallized portion and is propelled when the consumable plug vaporizes in response to the high current density associated with ignition. In various embodiments the flyer disc is either an insulating material such as plastic, or polyimide, or formed integral to a top contact metal layer.

BRIEF DESCRIPTION OF THE DRAWINGS

The preferred embodiments of the present invention will be described with reference to the accompanying drawings in which.

DESCRIPTION OF THE PREFERRED EMBODIMENTS

Figure 1:
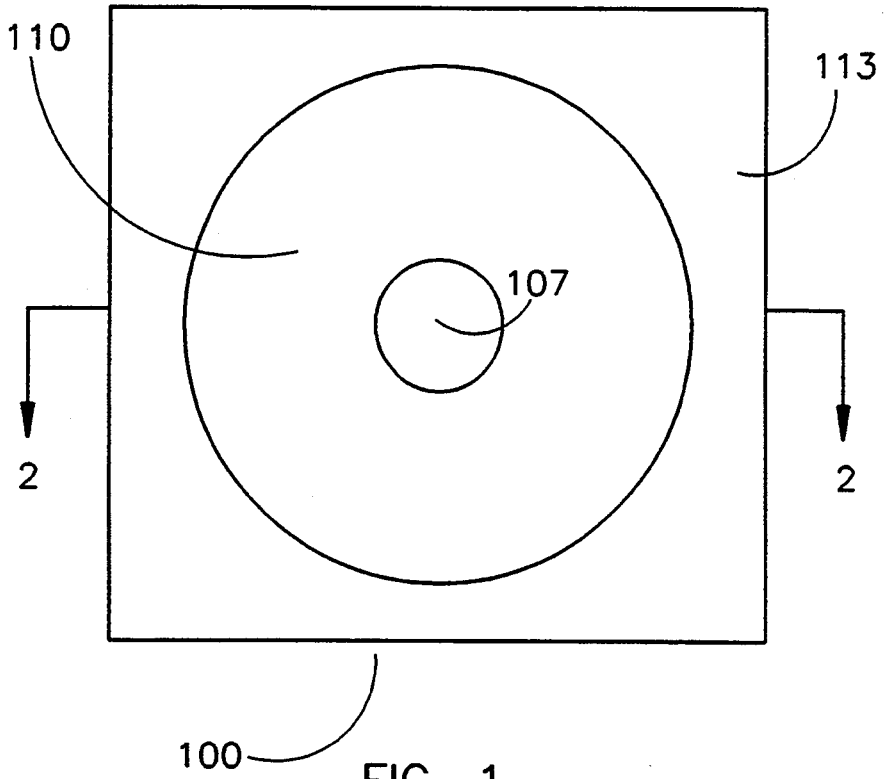
FIG. 1 is a top view of a semiconductor slapper ignitor according to one embodiment of the present invention.
Figure 2:
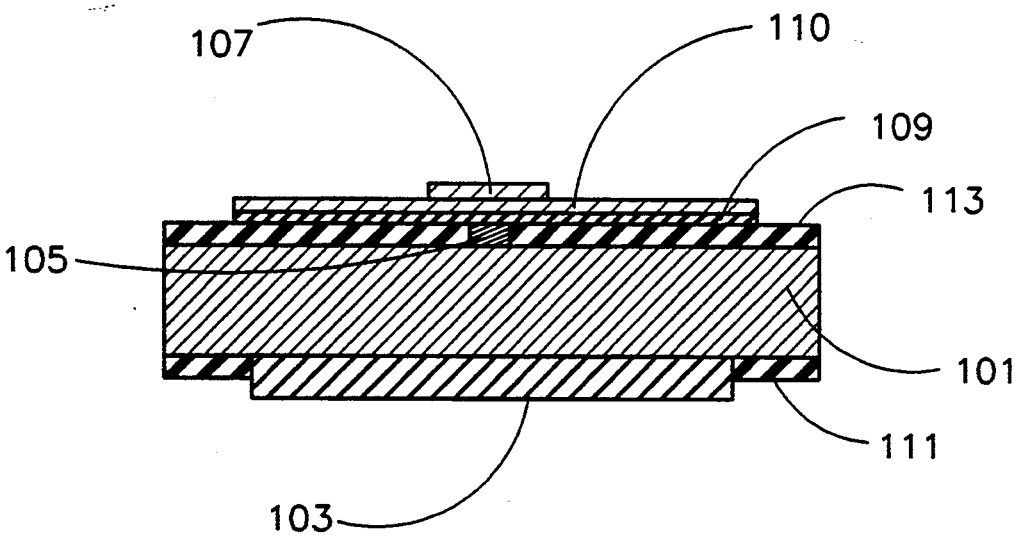
FIG. 2 is a cross-sectional view of the semiconductor slapper ignitor shown in FIG. 1 and taken along line 2—2.

FIGS. 1 and 2 show a top view and cross-section of a semiconductor ignitor 100 according to the present invention. The ignitor 100 is fabricated on a double polished n-type silicon substrate 101 having a <100> orientation and typically a 1.3 ohm-cm resistivity. It should be noted, however, that substrates exhibiting resistivities between 0.1 and 2.0 ohm-cm have also been tested successfully. Portions of the top and bottom surfaces of the substrate 101 are metallized 103, 105 to create two back-to-back Schottky barrier diodes. The metallized portion of the top surface resembles a small metal plug 105 which is typically surrounded by a thick oxide ring ($SiO_2$) 113. The oxide layer 113 and plug 105 may be overlaid with metal to form an electrical contact 109. The bottom surface also comprises a metallized portion 103, which is larger than the metal plug 105 located on the top surface, and which doubles as an electrical contact. The bottom surface is also provided with a ring of insulating material 111 which surrounds the metallized region 103 and extends at least as far as the edges of the substrate 101.

A flyer disc 107 is positioned concentric with and immediately ahead of the consumable plug 105 and the layer of contact metal 109. The disc 107 is preferably a plastic, such as polyimide, and in a typical application would be 0.005 inches in diameter and 0.001 inches thick. The disc material should be chosen to withstand the intense pressure and temperature developed when the consumable plug 105 vaporizes. An ideal material would not significantly soften, or otherwise lose its structural rigidity when in contact with a hot plasma for a brief period of time (i.e. less than 0.001 seconds).

Figure 3:
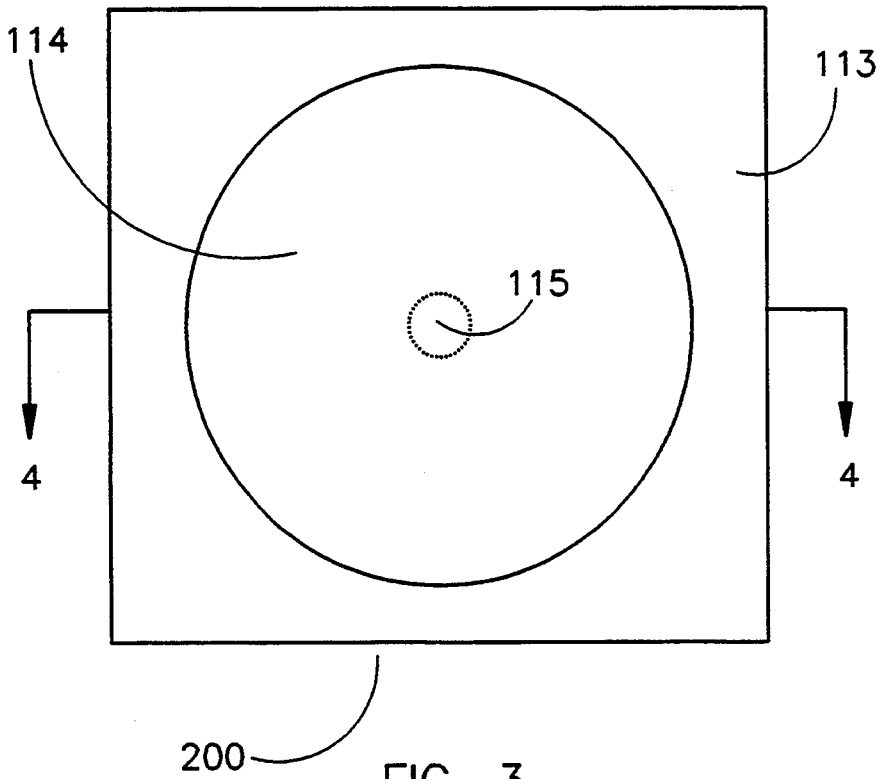
FIG. 3 is a top view of a semiconductor ignitor according to a second embodiment of the present invention.
Figure 4:
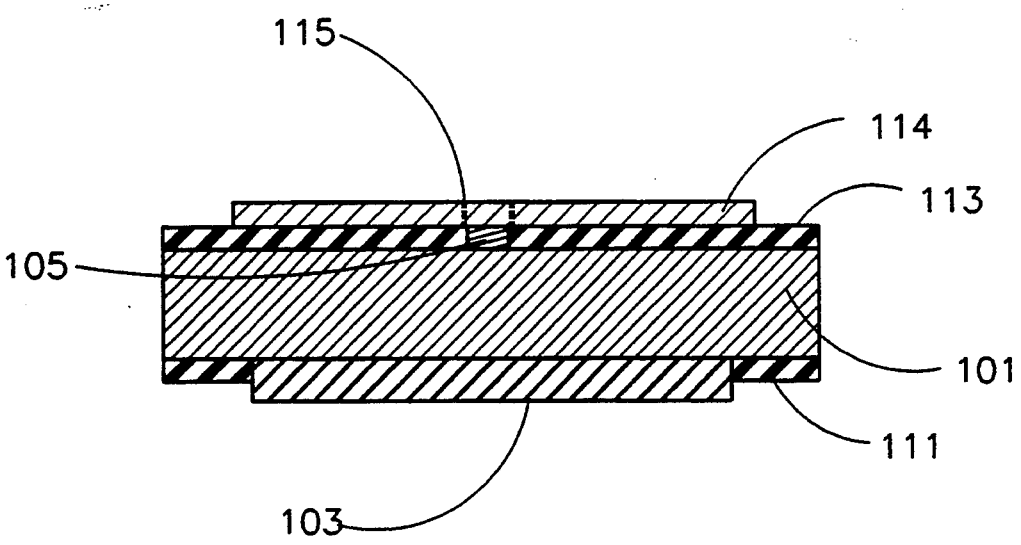
FIG. 4 is a cross-sectional view of the semiconductor slapper ignitor shown in FIG. 3 and taken along line 4—4.

In an alternate embodiment, shown in FIGS. 3 and 4, the need for a separate flyer disc is obviated through the use of a conductive contact metal layer 114 with a high melting point, further provided with perforations 115 in the form of a circle. Such an arrangement produces an integral flying disc which is dislodged in response to breakdown of the topside diode (i.e. plug) 105. Suitable materials for the topside layer 114 include platinum, molybdenum, titanium, nickel and tungsten.

In a preferred embodiment, a 10,00Å thick layer of $SiO_2$ is grown on both sides of a double polished silicon substrate 101 in pyrogenic steam at 1000° C. for approximately 300 minutes. The back, or bottom, side of the substrate 101 is coated with a thin layer of photoresist and softbaked in a convection oven at 100° C. for 30 minutes. A 120 mil-diameter hole is then exposed and developed upon this surface. At this point, the top side of the substrate 101 is also coated with photoresist, and the assembly hardbaked in a convection oven at 140° C. for 30 minutes. Bathing the assembly in a buffered oxide etch produces a 120 mil hole in the bottom oxide layer, leaving a portion of the silicon substrate 101 exposed. The remaining oxide on the bottom surface is etched down to a thickness of about 2500Å. Later, a 2500Å thick layer of platinum is sputtered into the 120 mil hole and annealed, forming a Schottky barrier diode 103 on the back surface of the silicon substrate 101.

In order to form the metal plug 105 on the top surface of the substrate 101, the hardcoat on the top surface is stripped and another thin coat of photoresist applied upon the 10,000Å thick oxide layer 113. A 5 micron square hole is exposed on the top surface of the assembly, and is subsequently etched down to the silicon substrate 101. A layer of aluminum approximately 5000Å thick is then laid by planetary sputtering upon the oxide layer 113. As a consequence, the 5 micron square hole is filled forming a plug of aluminum 105 on the top surface of the substrate 101, and, after annealing, another Schottky barrier diode. Of course, other sizes and shapes of hole may be created, and in some cases it may be useful to provide a plurality of holes. However, a group of ignitors with more than one Schottky junction on top were tested and found to cause diversion of the firing current between pads prior to the creation of a viable plasma jet at any one location.

Where a separate flyer disc 107 is utilized, a 100Å thick, and 140 mil diameter contact pad of chromium 109 is deposited upon the aluminum plug 105 for purposes of adhesion. A final layer of gold 110, typically 500Å thick and of the same diameter as the chromium 109, is deposited atop the chromium 109 for environmental stability and shelf-life. This combination of metals has exhibited superior adhesion and environmental resistance while ensuring reliable performance of the semiconductor ignitor.

In operation, a voltage potential is created across bottom and top surfaces of the semiconductor ignitor 100 or 200. In tests, 300 volts applied across a 3 uF capacitor in series with a 60 ohm ballast resistor for approximately 1 msec successfully propelled a flyer-disk. Actual firing voltages can be accomodated by changing the substrate resistivity, the plug diode area and/or the dielectric thickness. The small size of the plug 105 relative to the bottom contact metal 103 ensures sufficient current density to vaporize the plug 105 thereby propelling the flyer disc 107, or dislodging the integral disc 115. Tests have shown that the thickness of the top oxide layer 113 on the surface of the substrate 101 influences the actual point of ignition. It is felt that in order to fire reliably, an ignitor must channel its energy into the centermost region of the chip. Oxide layers 113 having thicknesses appreciably less than 10,000Å exhibited point defect failures at numerous locations around the chip, causing a decrease in firing reliability.

While there has been described and illustrated specific embodiments of the invention, it will be obvious that various changes, modifications and additions can be made herein without departing from the field of the invention, which should be limited only by the scope of the appended claims.

We claim:

1. An RF-insensitive slapper ignitor comprising a silicon substrate having top and bottom faces, a first metallized portion centrally located on said bottom face to form a first Schottky barrier diode thereon, a second substantially smaller metallized portion centrally located on said top face to form a second Schottky barrier diode thereon, wherein said second metallized portion comprises a consumable plug thereon, a first annular insulating means surrounding said consumable plug on said top face, a second annular insulating means surrounding said first metallized portion on said bottom face, a metallic layer disposed atop said consumable plug and atop a substantial portion of said first annular insulating means on said top face, and a flyer disc consisting essentially of a circular pattern of relief cuts in said metallic layer which are concentric with said consumable plug.

2. The invention of claim 1 wherein said metallic layer is selected from the group consisting of platinum, molybdenum, titanium, nickel and tungsten.

* * * * *